United States Patent [19]

Shulman et al.

[11] 4,102,367

[45] Jul. 25, 1978

[54] AUTOMATIC FILLING DEVICE

[75] Inventors: Abe Shulman; Jere J. Willing, both of Chicago, Ill.

[73] Assignee: A-Jer Engineering, Inc., Niles, Ill.

[21] Appl. No.: 779,358

[22] Filed: Mar. 21, 1977

[51] Int. Cl.[2] ..... B65B 1/04; B65B 1/48

[52] U.S. Cl. ..... 141/231; 141/387; 425/258; 425/447

[58] Field of Search ..... 141/231, 198, 284, 232, 141/387-388, 140, 352; 425/256, 258, 259, 260, 447, 144

[56] References Cited

U.S. PATENT DOCUMENTS

| | | | |
|---|---|---|---|
| 795,613 | 7/1905 | Holtkott et al. | 425/447 |
| 2,202,797 | 5/1940 | Hoge et al. | 425/144 |
| 2,442,607 | 6/1948 | Leguillon et al. | 425/543 |
| 3,032,851 | 5/1962 | Gibbs | 425/439 |
| 3,190,494 | 6/1965 | Derror | 141/232 |
| 3,495,742 | 2/1970 | Adamik | 425/256 |
| 3,537,156 | 11/1970 | Glass | 425/256 |
| 3,626,998 | 12/1971 | Trusselle | 141/284 |
| 3,728,064 | 4/1973 | Conway | 425/447 |
| 3,822,794 | 7/1974 | Fougea | 198/862 |
| 3,826,602 | 7/1974 | Shaffer et al. | 425/447 |
| 3,871,801 | 3/1975 | Buchmann | 425/258 |
| 3,877,862 | 4/1975 | Murray | 425/258 |
| 3,880,562 | 4/1975 | Hujik | 425/447 |
| 3,889,728 | 6/1975 | Riche | 141/387 |

*Primary Examiner*—Henry K. Artis
*Assistant Examiner*—Willis Little
*Attorney, Agent, or Firm*—Silverman, Cass & Singer, Ltd.

[57] ABSTRACT

A system for filling containers such as for example, bottle molds intended for slush molding, with liquid such as slip. The containers are arranged along a line which is parallel with a track that guides the movement of a carriage. The carriage carries an arm that swings between two positions, one of which is raised above the line of the containers to permit movement of the carriage without interfering with the containers when desired, and the other of which is below the carriage and bringing the arm to a filling position relative to a container. The arm carries a filling nozzle which is intended to enter the mouth of the container, the nozzle having a probe which dips down into the container. Electrical circuitry is provided which for the most part is carried in the carriage, such circuitry cooperating with the probe of the nozzle and sensing elements on the track and carriage.

The circuitry includes means for sensing whether a container is properly in position and raising the arm while holding back the flow of liquid if the container is missing or out of alignment. If properly positioned and aligned, the arm will bring the nozzle into position to fill the container, will automatically sense when it is filled, stop the flow, raise the arm and cause the carriage to move to the next station. The proper sequence of energizing and de-energizing the drive means for moving the carriage horizontally as required and for moving the arm up and down is controlled automatically by the circuitry.

The system can be arranged to move to the end of the line and stop, or return all the way to the beginning of the line, or to effect the same filling operation in reverse, as for example, to top off the containers in case of evaporation during the first sequence of filling.

25 Claims, 9 Drawing Figures

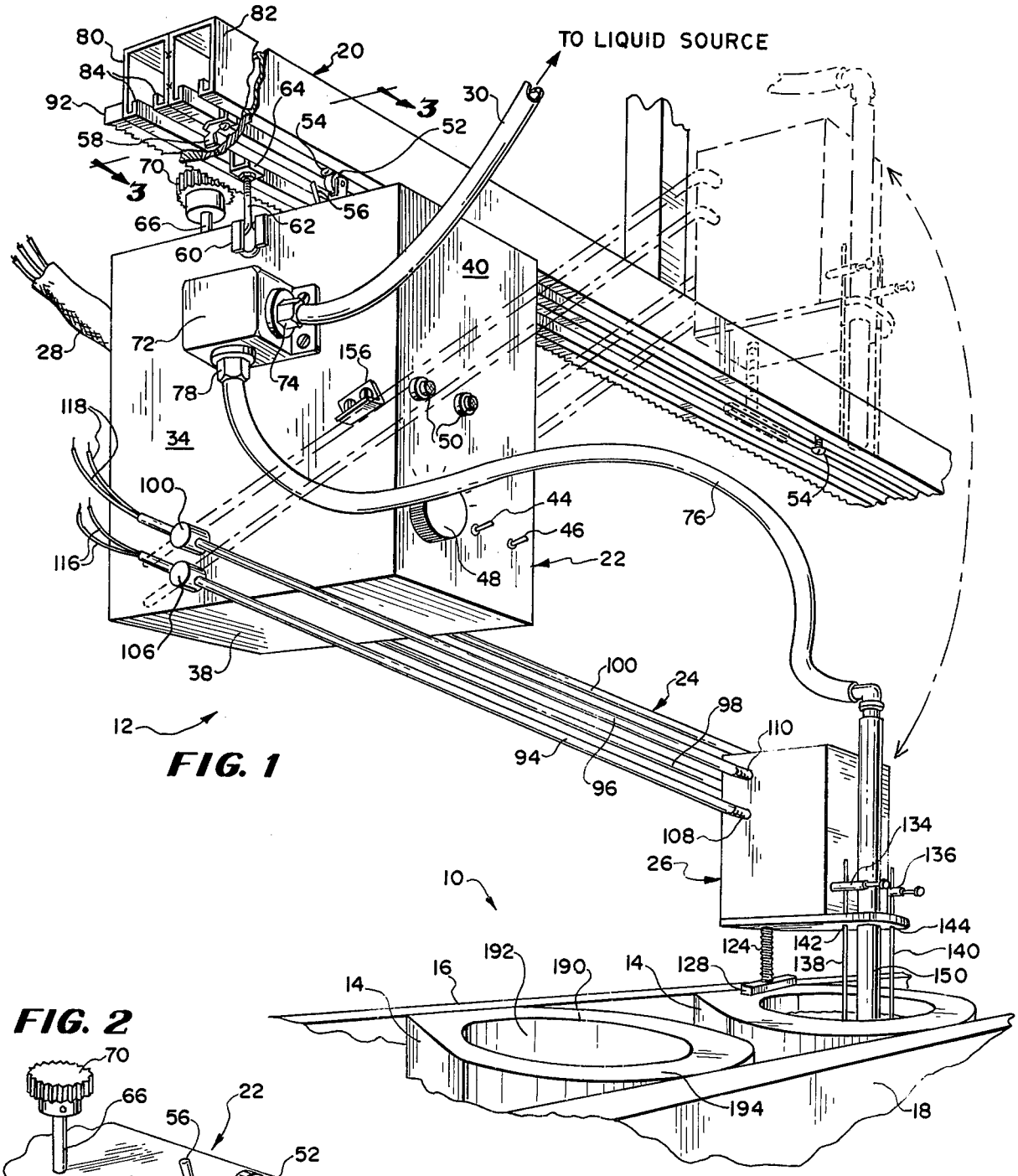
FIG. 1
FIG. 2
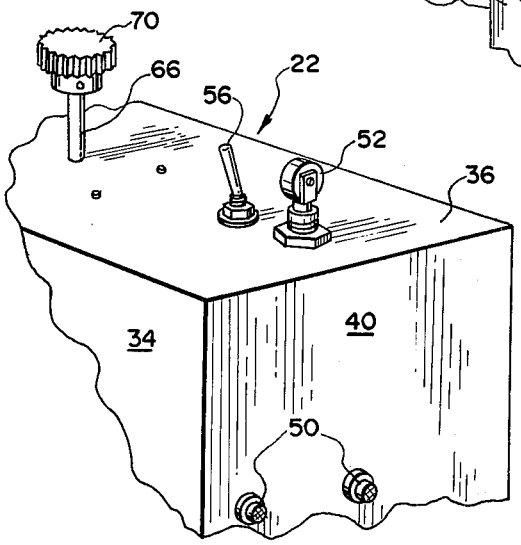
FIG. 3
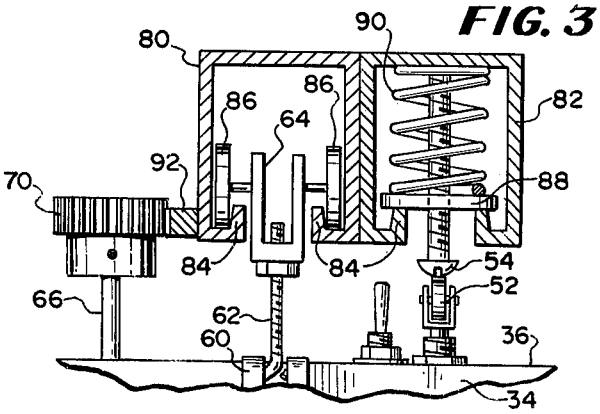

FIG. 4
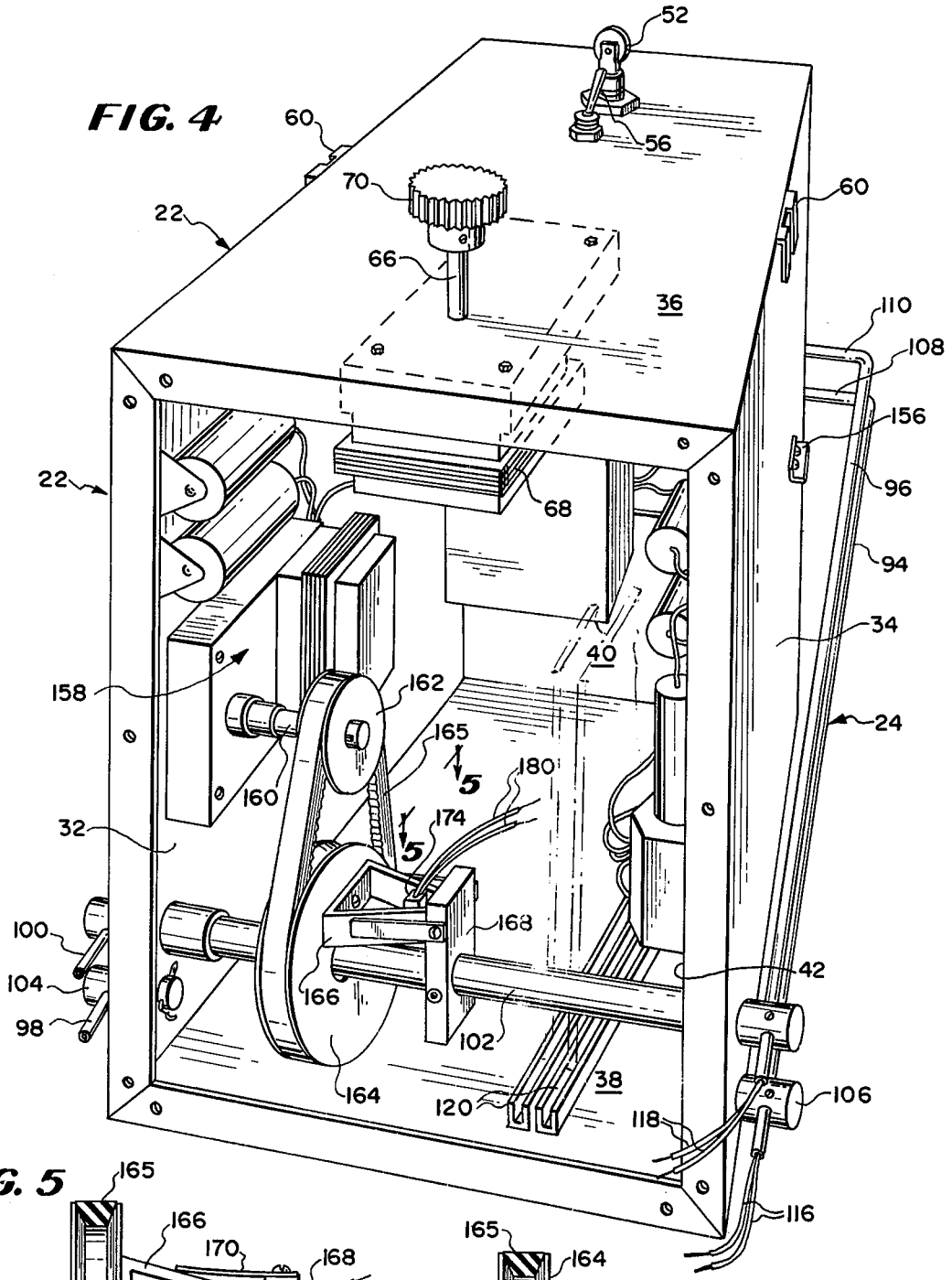
FIG. 5
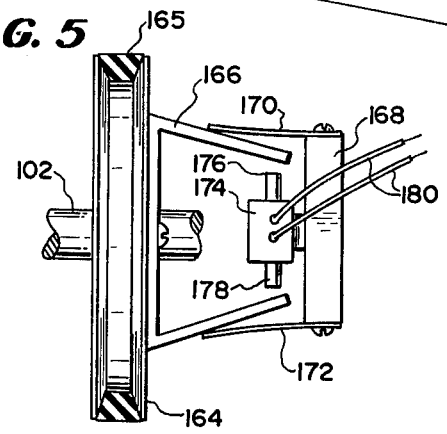
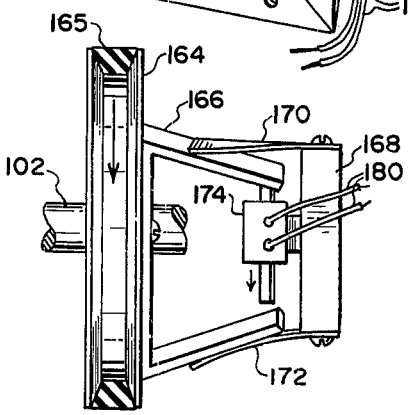
FIG. 6

AUTOMATIC FILLING DEVICE

BACKGROUND OF THE INVENTION

The field of the invention is filling containers generally, but more specifically the invention is concerned with a system and various features thereof as a subcombination of the system for filling molds for ceramic bottles.

Although an old art, slush molding is in extremely widespread use today for the manufacture of containers such as vases, jars, bottles and the like out of ceramic materials. In large production establishments potter's clay is mixed with water to provide a relatively free flowing slurry called slip that can be handled as a liquid. It is poured into molds which are permitted to remain quiescent for a time sufficient to have the slip immediately adjacent to interior surface of the mold set after which the still liquid center is poured out leaving a thin shell. This shell is permitted to dry sufficiently to become firm and removed from the mold. It thus becomes a hollow container after it is decorated and baked.

Many problems arise which must be solved in the factories where such processes are carried out. Foremost, of course, is the need for uniformity and high speed in production. The more manual operations required, the more expensive the product. The less uniform the product, the more rejections and breakage.

Solution of the problem of trying to achieve uniformity calls for filling the mold with the precise amount of slip and pouring the slip out of the molds at a time when a known volume of space will result due to the thickness of the remanent wall. Modern mold handling equipment permits of a large number of molds, for example ten or more, to be emptied simultaneously through the use of counterbalanced cradles, but the benefit of this type of equipment is to some extent offset by the requirement to fill the molds speedily and accurately. A workman moving a nozzle from mold to mold and filling by judgment cannot be expected to be as accurate as an automatic device. There is a certain amount of spillage, also. If he is careful, taking a bit more time to fill, the first-filled containers may end up with thicker walls than the last filled because slip sets at a very fast rate — at least as it is used with a viscosity to promote fast setting for high speed production.

If one considers that the ceramic bottles are to carry an expensive commodity, such as for example, whiskey, a larger than required volume causes the filler to lose profits; a smaller than required volume causes the filler to have difficulty with the tax authorities. Accordingly, the manufacturing must be geared to the conditions of conservatism where the larger volume of the resulting container will be achieved in most cases, the consequences of less profits being less troublesome than not meeting the approval of tax authorities standards for required liquid volume.

An accurate filling system can satisfy the requirements of highest profits and least difficulty with tax authorities by producing uniform containers on a continuous basis. This can be done at high speed and quite reliably by the use of the invention.

In connection with the comment on reliability made above, a factory where ceramic containers are being made in large quantities is subject to a continuous atmosphere of clay dust, splashing and leaking of slip, etc. The dirt and clay settle on everything, the pouring of the liquid slip from the molds during the emptying thereof causes spray and flying droplets of slip in the vicinity of the molds, etc. As a result, any equipment which is used in the vicinity of the molding operation is subjected to this atmosphere and the splashing. Slip in large drops and splashes hardens quickly and is almost like cement. In dust form it clogs crevices and filters into electrical circuits to insulate contacts.

Accordingly, any equipment which is to be used for automatic filling must be robust, dust-resisting and must operate under adverse conditions described in order to be reliable. Without reliability, the benefits of automatic filling are lost because production speed and uniformity suffer.

The invention herein is believed to have solved the problems mentioned by providing a system which is rugged, reliable and flexible for different use requirements and which is capable of operating practically unattended in filling containers with liquid and achieving high uniformity at great speeds.

The system of the invention includes a carriage which has a filling nozzle associated therewith. The carriage is started down a line of containers on a track by the operator who can then leave the equipment and go to another system. The carriage moves to the first container, senses whether the container is in proper position, fills the container if all is well, moves to the next container and fills it if it is in proper condition, and so on. When the carriage reaches the end of the line it can be made to stop and sound a warning, or it can be made to return to its initial position without doing any filling or it can be made automatically to reverse and refill the containers, topping them up to compensate for evaporation, again sounding an alarm when it reaches its original position.

It may be noted here that in a practical system embodying the invention the timing device used by the molder to signify the precise setting time has a warning signal that advises when the molds are to be poured. The invention enables the molds to be filled and topped off in a reverse run in a time shorter than that required for setting; hence it is usually unnecessary for the carriage to sound an alarm either when the first pass has been made or when it reaches home.

PRIOR ART

The prior art which is known to the applicants is listed below:

| | | |
|---|---|---|
| 795,613 | Holtkoff et al. | July 25, 1905 |
| 2,202,797 | Hoge et al. | May 28, 1940 |
| 2,442,607 | Leguillon et al. | June 1, 1948 |
| 3,032,851 | Gibbs | May 8, 1962 |
| 3,495,742 | Adamik | February 17, 1970 |
| 3,537,156 | Glass | November 3, 1970 |
| 3,728,064 | Conway | April 17, 1973 |
| 3,822,794 | Fougea | July 9, 1974 |
| 3,826,602 | Shaffer et al. | July 30, 1974 |
| 3,871,801 | Buchmann | March 18, 1975 |
| 3,877,862 | Murray | April 15, 1975 |
| 3,880,562 | Hujik | April 29, 1975 |

Applicants do not represent that the above prior art patents comprise a comprehensive list of the prior art relating to the invention or even that the patents are in analagous art, but state that these comprise the results of a search made through Class 141, subclasses 284, 352, 387 and Class 425, subclasses 256, 258, 259, 260 and 447. Applicants do not represent that such search was exhaustive.

A general comment on the above described prior art is that it differs from the invention herein in the respect that for the most part it discloses complex mechanical devices which do not perform all of the important functions claimed for the invention herein. The use of a carriage moving on a track for carrying filling nozzles to molds is known, but the control and procedure which result from the invention are not.

One of the prior art patents, namely U.S. Pat. No. 2,202,797 discloses a hopper or container which carries a limited quantity of material arranged to travel back and forth along the front of a molding chamber or oven. The movement of the hopper indexes the mold tables and causes a measured charge of material to be placed in the molds on the tables in succession. In the present invention, there is no measured charge since the probes measure the exact level of the liquid filling the container and stop the flow of slip at that instant. The complete system operates differently. Other features of the invention are not found in this patent.

It is not believed that the other prior art patents teach anything more significant than that which has been described above.

BRIEF DESCRIPTION OF THE DRAWINGS

FIG. 1 is a fragmentary perspective view showing the system of the invention arranged for filling molds with slip in a factory engaged in slush molding;

FIG. 2 is a fragmentary top perspective view of the carriage of the system;

FIG. 3 is a fragmentary sectional view taken generally along the line 3—3 of FIG. 1 and in the indicated direction;

FIG. 4 is a rear perspective view of the carriage with the rear cover removed and some of the circuitry not shown in order to illustrate the slip clutch and its switch arrangement;

FIGS. 5 and 6 are detailed fragmentary plan views of the slip clutch to show its operation;

DESCRIPTION OF THE PREFERRED EMBODIMENT

Figure 7:
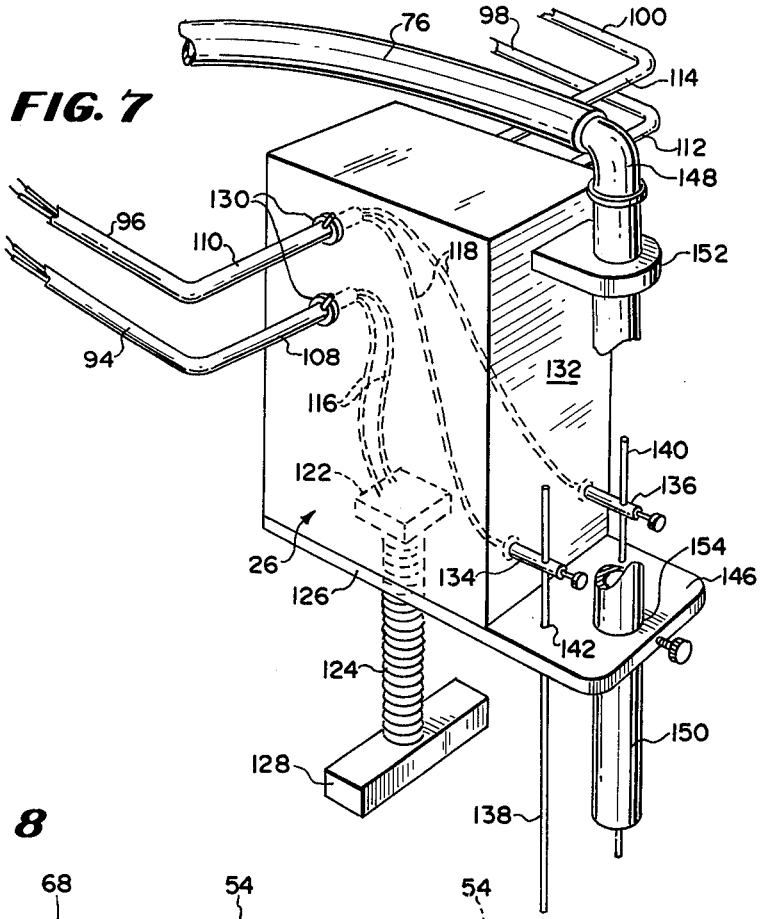
FIG. 7 is a fragmentary perspective view of the free end of the swinging arm of the invention.

An understanding and appreciation of the invention will be had by first considering the general environment in which it is used and a brief explanation of the operation. This will be described in connection with a factory in which slush molding is carried on for the purpose of making ceramic bottles, for example.

Each bottle as a rule is molded independently of all others and hence each has its own mold usually held in some type of carrier, called a holder herein. All that can be seen from the exterior is a large bulky member which may be held together by clamps or straps which has a mouth opening to a passageway which may be tapered to pilot the liquid into the interior of the mold. The mold and carrier may be the same in certain instances, but the combined article will be called a holder herein.

The factory has benches or tables which are intended to support the molds, and as stated above, there may be a large cradle capable of holding from a few to a dozen or more of the holders clamped in place. This cradle is balanced so that it can be manually tipped to pour the liquid out of the holders. Locks may be provided for safety, and as will be seen, these locks prevent the turning of the cradle unless certain conditions are met. If not cooperating with the system of the invention, the conditions are of no consequence to the description herein.

The workman has a nozzle with a valve near its end which is connected to an overhead source of slip and he walks down the line of holders, fills each, sets a timer and goes to the next group. When the time has run its course, the timer sounds an alarm and the workman tips the cradle, spilling out the excess slip. He erects the cradle, and may let the formed bottles dry for another period of time. He then removes a hold-down device from the top of the cradle, thus releasing all of the holders, removes them and stacks them on a transport dolly and replaces them with others. In certain instances, he may open the holders, remove the bottles or other items and reclose the holders.

The system of the invention takes care of the work of filling the holders. The external appearance of the system is quite simple. One sees a track above the line of holders that carries a box-like carriage capable of sliding along the track. Electrical connections extend to the carriage from the power system of the factory. The carriage has a pivotal arm connected to it that has a block-like device on its free end. This block-like device carries a pair of probes which are arranged to enter the mouth of the holder, it carries a mechanical feeler on its bottom arranged to come into engagement with the shoulder of the holder surrounding the mouth, and there is a nozzle on the block-like device which connects by means of a flexible hose with a valve that may be carried on the carriage. The source of slip of the factory connects to the valve.

The system of the invention does the work of filling the holders automatically.

Assuming that the carriage is at one end of the track which can be called "home," when all is ready, the workman presses a switch on the carriage or remote therefrom and starts his timer for that cradle of holders. The carriage moves down the track and stops at the first holder. Here the arm lowers itself to the holder until the nozzle is right inside or directly over the mouth. The valve is opened by the circuitry, slip fills the cavity in the holder and when a certain level has been reached, the valve is closed, the arm raises itself above the line of holders to its original upper position and the carriage automatically moves to the next holder and repeats.

When the end of the line is reached, the carriage may stop or it may quickly return to home without lowering the arm or, after a certain delay time it may start back along the rail and retrace its steps, stopping at each holder and topping it off to take care of intermediate evaporation. These alternatives are taken care of by settings made prior to the cycle on the carriage.

The invention is concerned with means for accomplishing the functions which have been described and with means for assuring that the operation is reliable. In this latter respect the system will not act to pour slip unless there is a holder in position and further unless its mouth is in the proper location with respect to the nozzle. The electrical circuitry of the system is all contained in the carriage and on the arm except, perhaps, for the electrical valve which operates the pouring nozzle. This need not be carried on the carriage but preferably is so located.

Other aspects of rendering the system foolproof will become apparent as the description of details proceeds.

In FIG. 1, there is illustrated a fragmentary portion of a line of holders arranged to be filled with slip. The general reference character 10 is used to designate the conventional equipment of the factory and the character 12 is used to designate the system of the invention.

With respect to the conventional apparatus, the holders 14 are mounted in a cradle or fixture, front and rear rails 16 and 18 being shown. These are more symbolic than actually illustrative in that the details may be more complex and involve more structure than is illustrated. The structural members 16 and 18 are representative and should not be considered limiting. For example, hold-down means for actually clamping the holders 14 within the cradle are not shown, but will be required if multiple holders are to be handled at one time.

The system 12 of the invention is made up of the general parts which have been alluded to, namely the rail or track 20, the carriage 22, the arm 24 and the block-like device 26 which serves as the support for several elements, which will be called the end caddy. The several connections between the system 12 and the various facilities at the factory comprise the flexible electric cable 28 which brings electrical power to the system and the flexible conduit 30 which carries the liquid — in this case slip — to the system 12. In the case of both the cable 28 and the conduit 30, arrangements must be made to assure that the carriage 22 is free to move along the entire length of the track 20 without interference or binding from these two connections.

The carriage 22 is a robust metal box, preferably, having side walls 32 and 34, top and bottom walls 36 and 38, a front wall 40 which serves as a control panel and having its rear open as seen at 42 in FIG. 4, adapted to be covered by means of a cover plate (not shown). Thus the carriage 22 is fully enclosed on the sides and face where the majority of splashing and dust occurs and its rear face 42 is normally covered. The front wall 40 carries controls which are shown to comprise two switches 44 and 46, a knob 48 for operating a rotary switch and several jewels 50 for displaying the light from indicator lamps in the electrical circuit. The top wall 36 of the carriage carries a roller 52 which is mounted for some vertical movement and when depressed operates a microswitch that is carried on the inside of the wall 36. This switch will be described below in connection with the circuitry, but for the time being it should be understood that the cooperation of the roller with stop members that are spaced along the track 20 establishes the several stations where the carriage is required to stop as it performs its functions. The stop members comprise the heads of bolts or screws as shown at 54 in FIGS. 1 and 3. The engagement of the stop members 54 with the roller 52 throws a switch to be described.

In the specification and claims appended, the roller 52, stop members or screwheads 54 and the switch which is operated thereby are called presence-sensing means since in fact, they cooperate to sense when the carriage is present at a given station. The function is performed by two types of elements, the one type being that which is on the carriage 22 and the other type comprising that which is located in spaced locations along the track 20. There is only one of the first type of element but a plurality of the second type of element. Instead of the mechanical means for throwing the switch, the presence sensing means could comprise a magnetic reed switch located on the wall 36 in place of the roller 52 and its microswitch, while the stop members 54 could comprise small magnets which cause the reed switch to operate when the carriage 22 moves into position.

The carriage 22 also carries another switch on its interior which is operated by a toggle lever 56 mounted on the top wall 36. This toggle lever 56 cooperates with mechanical stop members at opposite ends of the track 20, one of which is seen in FIG. 1 at 58. These stop members act to stop the movement of the carriage and/or reverse the movement thereof, if desired. This will also be explained below.

The side walls 34 and 32 carry slide sockets such as shown at 60 on the exterior thereof within which there are removably engaged hangers 62 of relatively simple construction including threaded shanks that can be screwed into yokes such as 64 in FIG. 3.

An additional element that is provided on the exterior of the carriage 22 is the vertical shaft 66 which is coupled to an electric motor 68 mounted on the interior of the carriage 22 and has a pinion gear 70 fixed to its upper end. The motor 68 is called the horizontal drive motor and its purpose is to move the carriage 22 along the track 20.

The wall 34 may support an electrically operated valve 72 which connects with the circuitry of the interior of the carriage 22 for controlling the pouring of the slip. This is shown generally in FIG. 1 having the flexible conduit 30 connected to its inlet fitting 74 and the flexible conduit 76 connected to its outlet fitting 78.

The arm 24 comprises the only other external part of the carriage 22 which has not been described. This will be done shortly, but first the track 20 and its details will be set forth.

The track 20 is formed of a pair of channel shaped rails 80 and 82 which are preferably welded together. The rails have interior reverse bent bottom flanges as best seen at 84 in FIG. 3 thereby forming pairs of grooves which are advantageous, at least for the rail 80. The yokes 64 of the carriage 22 mount small wheels 86 which ride easily in the grooves formed in that rail, out of the way of splashes and much dust. The wheels 86 could be arranged to ride on the edges of the upturned flanges. The stop members 54 are screwed into washers or plates 88 and these are adjustably held in place by the springs 90. By unscrewing the screw 54 the entire stop assembly can be moved to any desired location along the rail 82. At the desired location the screw 54 again is screwed into engagement between the plate 88 and the top inside wall of the rail 82. Any other similar arrangement can be used.

The rail 80 has a rack 92 secured along its back edge and when the carriage is in place the pinion gear 70 meshes with the rack. Thus, rotation of the pinion 70 drives the carriage 22 along the rail 80 and hence along the track 20.

The arm 24 is formed of two pair of parallel tubular members, 94, 96, 98 and 100. A shaft 102 passes through the carriage adjacent the bottom wall 38 and is journalled in the walls 32 and 34. The rear ends of the tubular members 96 and 100 pass through and are engaged in the parts of the shaft 102 which protrude from the side walls. The rear ends of the tubular members 94 and 98 are engaged respectively in the stub shafts 104 and 106 which are journalled in the respective side walls 32 and 34. The axes of the stub shafts 104 and 106 are aligned and vertically spaced from the axis of the shaft 102. The front ends of the tubular members are bent inwardly at an angle of 90° and these ends 108,110, 112 and 114 are all journalled and retained by suitable means in the opposite side walls of the end caddy 26. The ends 108 and 112 are axially aligned, the ends 110 and 114 are axially aligned and these axes are vertically spaced apart by the same distance as the axes of the shaft 102 and the stub shafts 104, 106.

As a result of this arrangement the tubular members of the arms are always parallel with one another as the arm swings in an arc up and down; in addition, the caddy 26 always remains in the same spatial disposition notwithstanding it is moving up and down.

The tubular members of the arms are hollow and open to the interior of the caddy 26. Thus, electric wires can be threaded through the tubular members from the caddy 26 to the rear ends of the tubular members. In the embodiment illustrated and described, one pair of wires 116 passes through the tubular member 94 and another pair of wires 118 passes through the tubular member 96. As will be explained, these wires are in circuit with the sensing and control functions of the apparatus. They are connected to plugs or connectors that are mounted on the rear cover member (not shown) of the carriage 22 along with a large connector to connect the cable 28. These wires lead to the circuitry which is contained within the carriage 22, most of which is not shown in the views of the carriage. The circuitry for the most part would be mounted on printed circuit boards (shown in broken lines) mounted in suitable brackets, for example those shown at 120.

Referring now to FIG. 7, the caddy 26 is illustrated there in some detail. On its interior it has a pushbutton switch 122 connected to a feeler 124 passing through the bottom wall 126 of the caddy and having a bar 128 secured to the bottom of the feeler 124. The feeler could be a tightly coiled spring encased in a soft plastic sheath or some such expedient. The switch 122 has its leads 116 passing to the interior of the tubular member 94 by way of the end 108 which, as seen, is mounted by any suitable means such as pins and washers to prevent movement of the caddy 26 laterally. As would be understood, once the caddy 26 is in position, the mounting of the tubular members at their pivotal ends together with the washers and pins, as shown at 130 would retain the caddy 26 centered.

The front wall 132 of the caddy 26 has a pair of spaced push-button binding posts 134 mounted thereon having connection on the interior of the caddy with the wires 118 that pass into the end 110 and thence through the tubular member 96. Stiff conductors such as copper or brass wires 138 and 140 are clamped into the respective binding posts 134 and 136 and extend through suitable passageways 142 and 144 in the front extension 146 of the bottom wall 126 of the caddy 26. The box-like part of caddy 26 is formed of insulating material such as plastic. The flexible conduit 76 connects with an L-fitting 148 which in turn has a vertical pipe or nozzle 150 connected therewith. This nozzle may pass through a bracket 152 mounted on the front wall 132 of the caddy 26 to steady the nozzle 150 and through a hole 154 drilled in the extension 146. The nozzle 150 extends substantially below the extension 146 between the two bottom ends of the conductors 138 and 140, although these latter extend slightly below the nozzle to provide the function of sensing the level of the liquid in the holder, as will be explained.

Advantageously, the bottom portions of the wires 138 and 140 are coated with some non-wettable material such as Teflon or the like leaving the tips bare. They comprise the probe of the arm 24.

The two end positions of the arm 24 of the apparatus 12 are shown in broken and solid lines in FIG. 1. In its uppermost position, the carriage 22 is free to move along the track 20 without interfering with the holders 14 of the apparatus carrying the holders, as for example the rails 16 and 18. In its lowermost normal position the arm 24 is in position to cause the holders to be filled with liquid. This will be explained.

The uppermost position is determined by the position of small brackets such as 156 mounted on the side walls 32 and 34 of the carriage 22.

From FIGS. 4, 5 and 6 one can see the means for driving the arm 24 vertically and for obtaining control signals to cover different conditions of operation. Like the motor 68, the motor 158 which drives the arm 24 is a reversible motor. A shaft 160 from the motor drives a sheave 162 which in turn drives a wheel 164 through a flexible belt 165. The wheel 164 is loosely mounted on the shaft 102 but has a U-shaped bracket 166 secured to one face thereof radially outward of the shaft. The shaft 102 has a block 168 fixed to the shaft close to the bracket 166 provided with a pair of flexible arms 170 and 172 that straddle the arms of the bracket as best seen in FIG. 5. A small switch 174 is mounted on the face of the block also between the arms of the bracket 166 and likewise offset from center.

The assembly described comprises a type of slip clutch which operates by transmitting the rotary movement of the wheel 164 to the shaft 102 through the arms of the bracket 166, the flexible arms 170, 172 and the block 168. If the arm 24 presents no resistance to swinging movement, the parts are arranged as shown in FIG. 5. The switch 174 is in its normal condition. If however there is resistance, the arms 170 and 172 twist relative to the arms of the bracket 166 as a result of which the one arm or the other of said bracket will engage the switch actuating pusher 176 to open or close an electrical circuit. In FIG. 6 it is seen that the pusher 176 has been engaged at the top and been pushed down. In the opposite rotational direction, the opposite condition will obtain.

The leads 180 from the switch 174 pass to the circuitry within the carriage 22.

Figure 8:
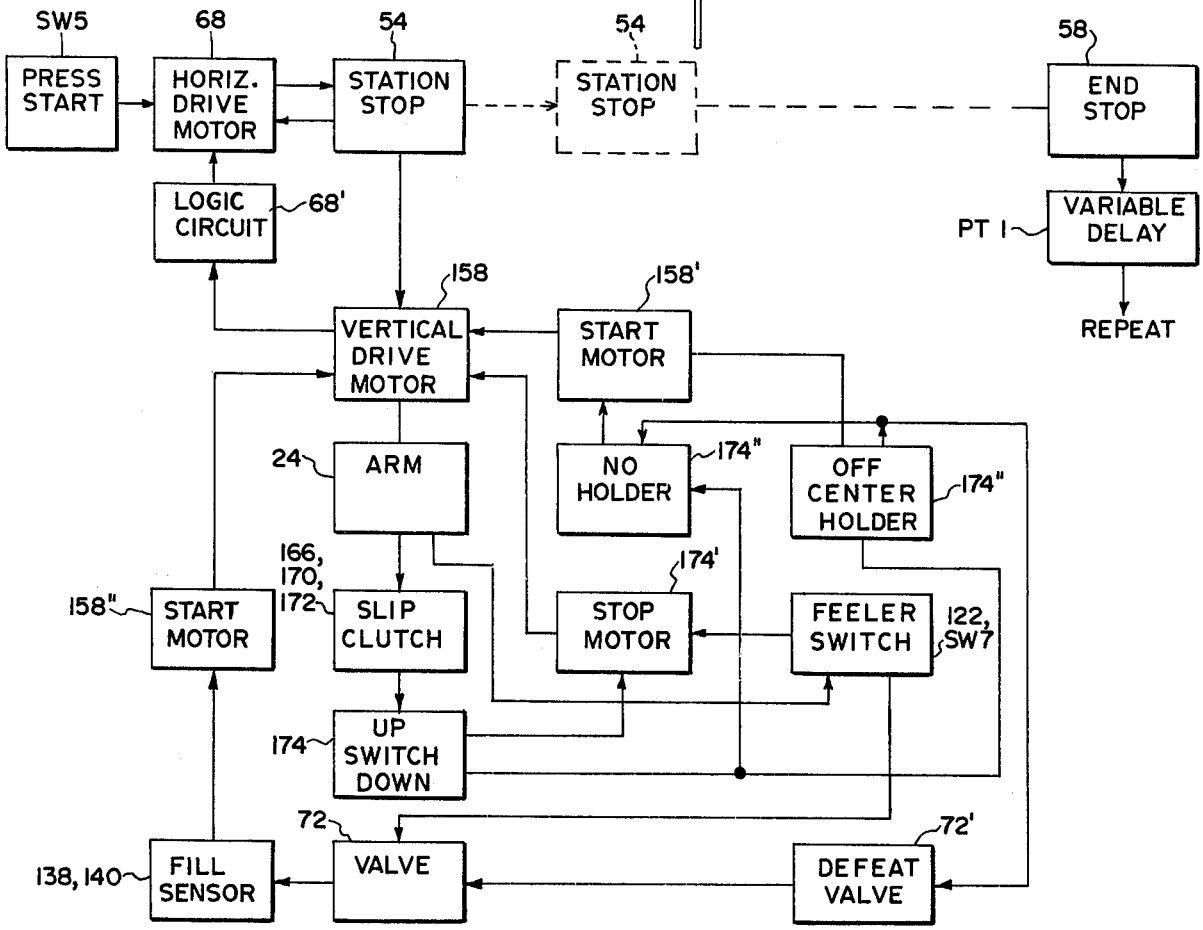
FIG. 8 is a block diagram illustrating structure and function of the invention.
Figure 9:
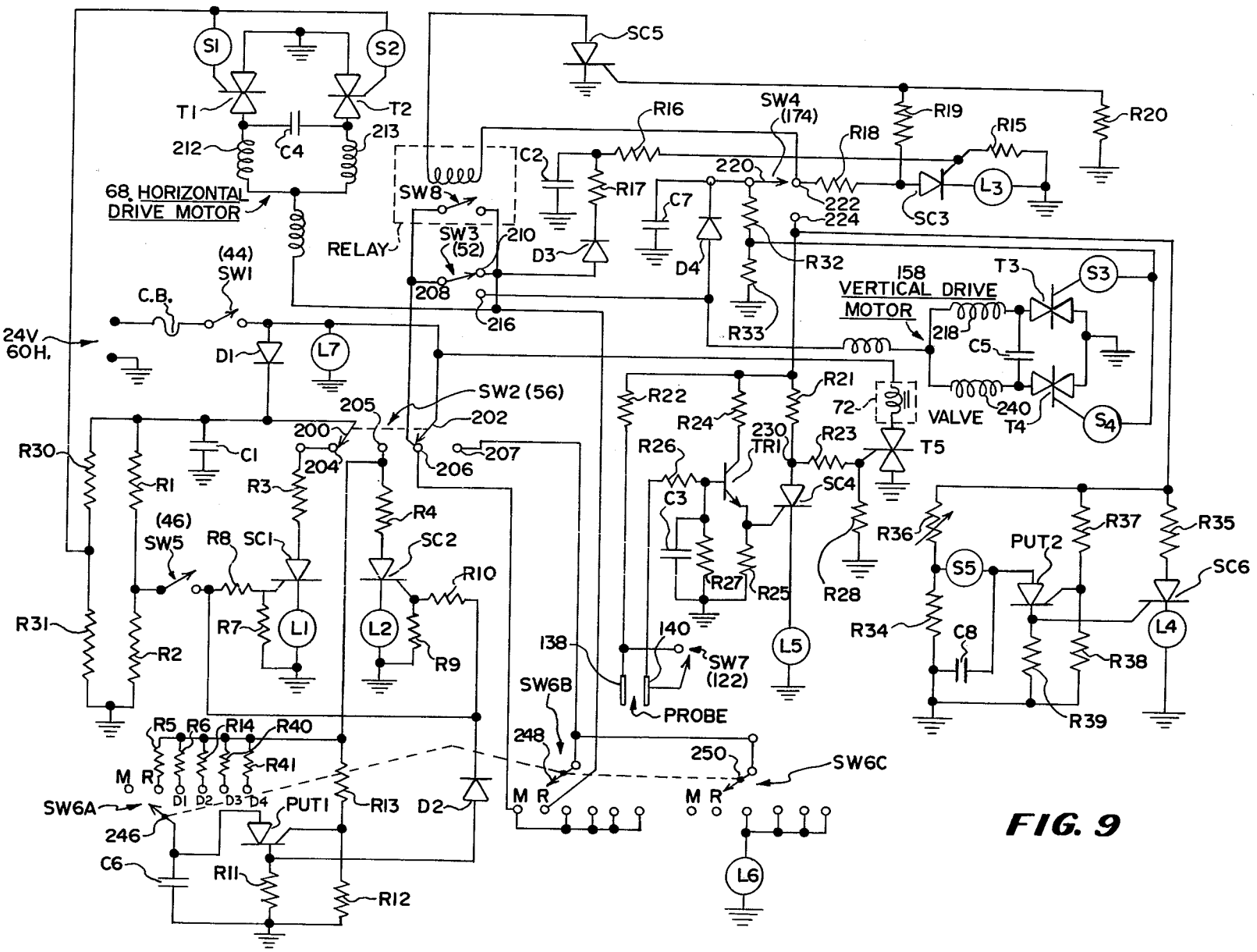
FIG. 9 is a circuit diagram of the electrical portions of the invention.

Attention is now invited to FIGS. 8 and 9 which illustrate the electrical operation and functioning of the system. Initially, assume that the carriage 26 is all the way to the home end of the track 29, say the right end. The power to the system is provided at the terminals shown on the left of the circuit diagram FIG. 9, marked 24 V 60 H. This signifies that the input voltage is 24 at 60 hertz, this being A.C. The power is turned on by closing the switch SW1 manually. This could be for example, the switch 44 on the front wall 40, a normally open toggle switch. When it is closed, one of the pilot lamps 50 comes on, but nothing happens yet. This pilot lamp is L7 in the circuit diagram. The arm 24 is at its topmost position; the valve 72 is closed.

The holders 14 are all in position to be filled; the slip source is turned on and all is ready. The operator now closes the switch SW5 by depressing the toggle arm 46 on the wall or front panel 40. This is a momentary single pole single throw switch and as soon as depressed and released it springs back to its original position.

Instead of a manual toggle 46 on the front panel 40 the switch SW5 may be operated remotely from some other location by a switch that parallels switch SW5. As a matter of fact, several systems like 12 may be set in operation at one time by such a remote arrangement.

Throughout the circuit of FIG. 9 there are illustrated small circles with the letters L and S in these circles and numbers identifying the same. These devices are called opto-isolators and they operate in pairs. Each pair consists of a light emitting diode and a light sensitive transistor arranged to respond to the light of the diode. These devices are available commercially with various specifications.

When the switch SW5 is closed it turns the silicon controlled rectifier SC1 on and this locks in that condition. The resistors R1 and R2 comprise a voltage divider to operate the SC1. Resistors R7, R8 and R3 are current and voltage limiting resistors for the circuit. As soon as current flows in silicon controlled rectifier SC1, the light of the LED L1 comes on and stays on. The toggle switch SW2 is the reversing switch for the horizontal motor 68 and it is in condition shown in the diagram with the arms 200 and 202 on the contacts 204 and 206, respectively. The illumination of L1 turns on the transistor S1 and puts voltage on the gate of the triac T1. The roller 52 is now in its upper condition, its switch being SW3 with the arm 208 being on the contact 210.

The left hand coil 212 of the motor 68 is now energized and the motor 68 commences to rotate driving the pinion gear 70 and moving the carriage to the left along the track 20. This continues in the same direction until the first station along the track 20 is reached.

The stations are chosen by gauging the path of swinging of the arm 24 so that the mouth of holder 14 that is to be filled will be in perfect alignment with the probe 138, 140 and the nozzle 150. The holders 14 are arranged in a straight line (although it is possible to have them in a curved line in which case the track will have to follow the curvature in parallel relationship) and their positions are fairly well fixed. The holders have the mouths 190 also in a line, each mouth leading to the passageway 192 and surrounded by the shoulder 194 defining the mouth. The openings 190 are not always as relatively large as shown, but the arrangement will be understood to be applicable to a large variety of sizes and shapes of holder. As a matter of fact, the holders may be of different size in the same cradle without affecting the operation of the apparatus as will be appreciated from the description.

Assume now that the carriage 26 is moving horizontally and comes to the first station. Here the roller 52 encounters the protruding stop member 54. (Or the reed switch comes into juxtaposition relative to the magnet arranged to establish the carriage presence at the location where the carriage 26 is to stop at the first station.) Now the switch SW3 is actuated to move the arm 208 to the contact 216.

Looking at the block diagram, the block SW5 represents the first step in starting the operation of the system after the power has been turned on. The second block is marked 68 and this represents the function of starting the operation of the horizontal drive motor. The arrow pointing toward the station stop block signifies that the carriage is moving in that direction, the station stop being designated 54, equivalent to the stop member of that reference numeral.

The voltage is thus removed from the horizontal drive motor 68 and the triac T1 stops conducting. Through the contact 216 the voltage is now applied to the vertical drive motor 158, it being kept in mind that the carriage has stopped moving with the roller 52 depressed and the switch SW3 arm 208 on contact 216.

While the switch SW3 was in the condition with its arm 208 on the contact 210, the condenser C2 was charging through the diode D3 and the resistor R17. The voltage which was being built up also appeared from the top of the condenser to ground across the two resistors R15 and R16. At this time there is a voltage on the gate of the silicon controlled rectifier SC3 but no voltage on its anode because contact 216 is open. On this account there is no current flow through the light emitting diode L3 and no voltage on the gate of the triac T3, the latter voltage being controlled by the operation of the transistor S3.

As soon as the switch SW3 is changed to put the arm 208 on the contact 216, the anode of silicon controlled rectifier SC3 has voltage across it and the voltage of the condenser C2 discharge on the gate of SC3 starts that device conducting, this lighting the diode L3 and causing the transistor S3 to conduct. This, then, places a voltage on the gate of the upper triac T3 and, with the circuit to the coil 218 completed, current flows through the triac and drives the motor 158. The motor in turn rotates the clutch arm 166 and starts the lowering of the arm 24.

One should keep in mind that by the time this occurs, the condenser C2 has been fully discharged, there is no longer any voltage on the gate of SC3 so that if the arm 24 should come back to its uppermost position (as when the motor 218 is reversed, as explained hereinafter) the circuit to the coil 218 is open and the arm will not be driven downward again. This is an important consideration since it provides this positive prevention of the arm oscillating up and down and it eliminates the need for some complex mechanical switching arrangement to ensure that the vertical motor for lowering the arm is turned off when the arm comes back up to its first position.

Now the arm 24 is being lowered. In the block diagram, these functions are represented by the arrow leading downward to the block marked vertical drive motor 158 and the function arrow extending therefrom downward to the block marked arm 24.

For the moment, assure that no problem is encountered by the holder being awry. The nozzle 150 and the probe 138, 140 enter the mouth 190 and move into the passageway 192. Immediately thereafter the bar 128 engages the shoulder 194 of the holder at the first position and operates the switch 122. This switch 122 is shown in the circuit diagram as SW7 and it is a normally closed, single pole single throw switch. If the switch SW7 is momentarily opened, it energizes the valve 72 in the manner which will be explained. This occurs before the next event which follows immediately thereafter, that is, the arm 24 encountering the resistance of the feeler 124.

Before explaining how the valve 72 is opened, the explanation of stopping the vertical drive motor 158 is in order. The switch 174 between the arms of the bracket 166 is the switch SW4 in the block diagram. It is a single pole double throw reset type which is normally arranged with its arm 220 on the contact 222. If the downwardly swinging arm encounters any resistance, this arm 220 is thrown to the contact 224. If this happens, obviously the silicon controlled rectifier SC3 loses its voltage, the LED L3 goes out, the transistor S3 is shut off and the triac T3 stops conducting. Obviously the motor 158 stops because its coil 218 is no longer energized. As will be seen, if the feeler 124 has not been engaged to operate the valve 72, the resistance which has been encountered is due to the arm hitting something before the bar 128 of the feeler engaged the shoulder 194. This could have been the holder being out of place and the nozzle or probes 138, 140 hitting the shoulder, or it could have been the caddy 26 hitting a rail or a part of the cradle, or the holder being totally absent in which case the two pairs of tubular members 94, 96, 98 and 100 will have closed the vertical distance between them and effected resistance by interference.

In such case, the circuit is arranged, after a slight delay, to reverse the vertical motor 218 and raise the arm.

Now continuing once more with the explanation of what occurs when the valve 72 is operated and all is well, the function and block diagram of FIG. 8 shows that from the arm block 24 there is a line to the slip clutch 166, 170, 172 and thereafter to the up and down switch 174. There is a function line to the feeler switch which is 122 and from there to the valve 72. If the valve 72 is opened, because the feeler bar 128 hit the shoulder 194 first, the up down switch will stop the motor, this being designated by the block 174' so marked that leads to the vertical drive motor. The feeler switch block 122 also stops the motor 158 while operating the valve.

Since the switch SW7 (122) is closed, when the bar 128 hits the shoulder 194 this switch will open. Shortly thereafter the switch SW4 shifts arm 220 to 224. When the switch SW7 opens, since the silicon controlled rectifier SC4 is not normally on, there is a high voltage at the point 230. Thus, the gate of triac T5 is turned on and the valve 72 opens. Note that there was a.c. on the triac T-5 at all times, but the gate was not active. With the gate energized, current flows in the valve solenoid and the flow of slip commences through the nozzle 150 into the holder. During this period of time, the switch SW7 (122) remains open due to the feeler 124 continuing to maintain upward pressure on the switch, the horizontal motor is not operating and the vertical motor is not operating. Incidentally, both of these motors are capacitor type a.c. motors which are directional by virtue of the energizing of one or the other of two of the several field coils in the motor.

As the liquid slip fills the holder cavity, its level rises and finally reaches the tips of the probe 138, 140. When this occurs the switch SW7 (122) is short-circuited because the slip is conductive and current flows between the tips. It will be appreciated that in the event that the liquid poured is non-conductive or only slightly conductive other known expedients can be used to sense the level. These could be floats, reflection transducers, etc.

The short circuiting of the switch SW7 closes the circuit to the base of the transistor TR1, turns it on, puts a voltage on the gate of the silicon controlled rectifier SC4 so that the latter conducts. This removes the gate voltage from the triac T5. The point 230 of the circuit in effect drops to ground potential through the silicon controlled rectifier SC4 and current stops flowing through the triac T5. The solenoid coil of the valve 72 is no longer energized; hence the valve resumes its normal condition which is "closed." After a short delay, which can be of the order of seconds, the arm 24 rises as will be explained. The purpose of the delay is to give the slip which is contained within the flexible conduit 76 and the nozzle 150 an opportunity to drain into the holder 14.

In the block and function diagram of FIG. 8, the switch SW4 (174) will be thrown under conditions where there is no holder indicated by the block 174''; where the holder 14 is off center as indicated by the block 174''' or when the feeler 124 has provided resistance to the downward movement of the arm 24 by engaging the shoulder 194 of the holder 14. It should be appreciated that the switch SW7 (122) will be opened before the switch SW4 (174) is thrown. The switch SW4 (174) is a so-called reset type of switch which means that once it is thrown to one position it remains in that position until thrown in the other position.

In the circumstance that the feeler switch SW7 is opened by the pressure of the feeler and the clutch switch SW4 thrown moving arm 220 from the contact 222 to the contact 224, the vertical drive motor 158 will stop its movement to carry the arm 24 downward, the motor remaining unenergized until the holder is filled with slip. In the other two mentioned circumstances, the vertical drive motor will also stop, but will be started after a slight delay, albeit in reverse direction to raise the arm 24. This is indicated by the block 158'. When the valve 72 closes because of the operation of the probes 138, 140 short circuiting the switch SW7, the motor 158 is also energized to raise the arm 24 and this is indicated by the function arrow extending from the block marked fill sensor 138, 140 to the block 158'' marked start motor. Also in the diagram it will be noted that at the same time that the functions of "no holder" and "off center holder" start the motor 158, the valve 72 is defeated as shown by the block 72'.

As stated above there is a slight delay which occurs after the holder 14 is filled, the switch SW7 (122) short circuited and the motor 158 energized to raise the arm 24. This delay is effected in the circuit which involves the programmed unijunction transistor PUT 2 in the lower right hand portion of the circuit diagram of FIG. 9. (Such transistors are available commercially and are used to provide a sharp pulse when a control voltage reaches a preset value that is determined by the circuit components. A second such transistor, namely PUT1 is used to obtain a delay after the carriage reaches the end of the track remote from home, as will be explained.)

The closing of the valve 72 was caused by the conduction of the transistor TR1 and the silicon controlled rectifier SC4 to remove the voltage from the point 230. The LED L5 is in series with SC4 and hence it is illuminated and causes its companion transistor S5 to conduct. At this time condenser C8 starts to charge through the potentiometer R36 which is mounted interior of the carriage. The resistors R37 and R38 establish the voltage reference at which the PUT2 will fire its short pulse, at which time the condenser C8 discharges through the PUT2. This occurs at a predetermined voltage.

When PUT2 fires, it produces a gate pulse on the silicon controlled rectifier SC6, illuminates the LED L4, operates the transistor S4 and thus causes the triac T4 to conduct. This energizes the vertical drive motor 158 through the winding 240 and the motor starts raising the arm 24. At this time the triac T3 cannot conduct because the circuit provides no voltage for its gate. This is because there is no charge on the condenser C2 since the roller 52 is still depressed and the arm 208 of the switch SW3 is on the contact 216.

As soon as the probe ends 138 and 140 pull out of the slip, the switch SW7 is closed. This keeps the valve locked out through the circuit which has been described by way of TR1, SC4 and T5. Obviously, when the switch SW4 is thrown due to the arm 24 meeting resistance under circumstances that the probe 138, 140 never entered the holder mouth 192 because the feeler 122 did not touch the shoulder 194, the valve 72 cannot open. This represents the block 72' in FIG. 8.

On the way up, the arm 24 has pulled away from the resistance that it has encountered, but recall that the switch SW4 is a reset type switch and once thrown to the position where the arm 220 is still on the contact 224 it will stay there until changed. When the arm 24 hits the bracket 156 it encounters resistance once more. This brings the action of the slip clutch of FIGS. 5 and 6 into operation, but in the opposite direction. The pusher 176 is moved by the arms of the bracket 166 to throw the arm 220 of the switch SW4 (174) from the contact 224 back to the contact 222. This puts a voltage on the anode of the silicon controlled rectifier SC3, but since there is no voltage on the gate of SC3 because the condenser C2 has not charged, as explained above, the LED L3 does not light. The motor 158 was stopped when the switch SW4 was originally moved and will stay deenergized from that time forward.

The condition of the arm 24 is now that it is in its first or topmost position, the motor 158 is not operating, the valve 72 is closed.

Note that since SC3 is not conducting at this point, there is a high voltage developed at its anode which is applied through the resistors R19 and R20 to the gate of the silicon controlled rectifier SC5. Current now flows through the solenoid coil of a relay SW8, this being a single pole single throw relay that is normally open. It is not accessible from the exterior of the carriage, being mounted on one of the printed circuit boards, for example. The roller switch SW3 has been depressed all the time that the carriage 22 was at the station and the arm 24 was raised or lowered or the cavity of the holder 14 was being filled. Because of this, the arm 208 was on the contact 216. The effect of closing the switch SW8 is the same as moving the switch arm 208 from the contact 216 to the contact 208. Now the circuit is in the same condition it was when the operator operated the start switch SW5 by momentarily depressing the toggle 46; hence the SC1 conducts since it has always had a voltage on its anode, etc. The motor coil 212 is energized and the motor 68 commences to drive the carriage 22 to the left, the first thing happening being that the roller 52 moves off the stop member 54 and takes control of the circuit from the relay switch SW8 that returns to its normal condition. This logic circuit is represented in FIG. 8 by the block 68'.

In the instance that the valve 72 is not turned on when the arm 24 comes to the bottom of its movement, to what may be considered its second position for filling the holder or thereabouts, the arm 24 does not rise immediately. Instead there is a slight delay which is produced in the same manner as the delay which occurs after the holder 14 is filled. This occurs when SC4 conducts, the LED L5 conducts, etc. There is no need to repeat the sequence of events which provides this delay.

The apparatus 12 operates in the manner described to fill all the holders 14. This is accomplished while the carriage is moving to the left as it has been described in this embodiment (although obviously, the first pass could be from left to right). The carriage stops at each station, chosen because of the arrangement of the holders by adjusting the positions of the presence sensing means 54. When the last station on the left has been passed by the carriage 22 it moves toward the left hand end of the track 20 which is shown in FIG. 1. A stop member 58 is placed on a suitable part of the track 20 to align with the toggle 56 of the switch SW2. This switch is a double throw double pole toggle switch and its arms 200 and 202 move from the contacts 204 and 206 to the contacts 205 and 207, respectively. The starting switch SW5 now has its circuit connected to the silicon controlled rectifier SC2 instead of SC1 and if and when SC2 conducts, the LED L2 will illuminate, operating the transistor S2 which will turn on the triac T2 and energize the coil 213. This will drive the carriage 22 to the right; however, whether or not this occurs depends upon the position of the switch SW6 (48).

The switch SW6 has three sections, SW6A, SW6B and SW6C, all ganged together and operated by the knob 48. There are at least three positions for the switch although 6 are shown. The operator sets the position before the cycle is started, depending upon the desires and requirements of the process. In the position marked M in FIG. 9, the carriage will stop and not return until the switch SW5 is operated by moving the toggle 46. This is the manual position. When the toggle 46 is thrown, the entire procedure described will be repeated, except the carriage will be moving from left to right.

If the switch SW6 is on the position marked R, the carriage 22 will strike the end stop 58 and immediately return to the home position all the way to the right without stopping.

If the switch SW6 is on any of the other positions when the left hand end of the track 20 is reached, the carriage will wait for a period of time depending upon the operation of the delay circuit of the PUT1 and then start back in the right hand direction automatically, stopping at each station and filling the holders 14. This is a function that is advantageously performed to "top up" the holders in case there was evaporation and lowering of the level during the period of time they were being filled their principal amounts.

The switch SW6A has the arm 246 moving with the arm 248 of the section SW6B and the arm 250 of the section SW6C. In the M position, the PUT1 delay circuit is open, the contacts 207 and 206 are connected together and the lamp L6 (which is one of the jewels 50 on the front panel 40) is not connected. Since SC2 must have a pulse to be turned on and there is no pulse forthcoming from SW5, the PUT1 circuit being open, there is no signal on the silicon controlled rectifier SC2 and the motor 68 stops and remains unenergized. The apparatus remains in this condition until the operator throws the switch SW5.

If, while the knob 48 is in the M position, the operator does operate the switch SW5, the motor 68 will start through the coil 213; hence the carriage 22 starts moving to the right. Since all conditions are the same from this point on as existed before, the apparatus will stop and attempt to fill at each station.

Assume now that the knob 48 of the switch SW6 is on the position R, signifying return. As soon as the carriage reaches the left hand end of the track 22 the switch SW2 is operated because the toggle 56 is thrown and the arms 200 and 202 change their positions. The arm 246 is on R and SC2 gets a pulse on its gate through the circuit including R5 and C6, R5 being chosen to be very small to provide practically no delay. SC2 thus starts the motor 68 operating to drive the carriage to the right. The arm 248 is on the position R which bypasses the roller switch SW3 at the point 210 thus preventing the operation of the vertical motor 158. Accordingly, the carriage 22 moves past each of the stations without stopping and returns to home at which point the switch SW2 is thrown back to its original condition, SC2 is non-conductive, SC1 is non-conductive and hence the motor 68 stops.

In the situation when the knob 48 is turned to any of the positions D1, D2, D3 and so on, there will be a larger resistor connected into the PUT1 circuit than the resistor R5 giving a longer delay time while the condenser C6 charges up. The section SW6B is open, so that the switch SW3 is not shorted so that the changeover to the vertical drive motor can occur at each station. The switch section SW6C is on a contact which lights the lamp L6 to advise the observer that there is a delay. If there has been one pass, for example, during the period of delay the carriage 22 will be waiting at the left hand end of the track 20 and none of the controls should be changed.

As soon as the voltage of the condenser C6 builds up to the predetermined value which has been built into the delay circuit through choice of the resistors R12 and R13, the PUT1 will fire, placing a pulse on the gate of SC2 and the latter will conduct free of further control from the PUT1 circuit.

The remainder of the operation can be understood from what has been explained, the carriage 22 moving to the right along the track 20 and stopping at each station to try to fill the holders and stopping when it has reached the right hand end of the track 20.

Mention has been made of an arrangement relating to the ability to unlock the holders under certain circumstances. A simple interlock switch could be added in parallel with the toggle switch SW3 that must be thrown in order to permit the locks of the hold-down device on the holders to be operated. This assures that the carriage will be fully out of the way of the hold-down device when it is swung upwards to give access to the holders or to remove the same. Obviously if the carriage is somewhere in the middle of its travel or the arm is down, there could be considerable damage if the structural members of the table or bench or the holder holddown apparatus is moved. Also, the interlock could prevent the slip from being poured out until a complete cycle has occurred.

Another advantageous expedient which could be built into the apparatus is the prevention of energizing the horizontal drive motor at any time unless the arm 24 is in its uppermost position. As it is now constituted the apparatus will start the horizontal motor when the arm 24 engages the bracket 156 and encounters resistance. If, however, there was a binding in the arm or resistance caused by some obstruction — even an operator's arm or shoulder, the switch SW4 will be thrown and the carriage will start to move. This could be obviated by means of an interlock switch located at the bracket 156 that must be thrown along with the switch SW4 in order to permit the operation of the horizontal drive motor 68. In this way the carriage will be positively prevented from moving unless the arm 24 is in its uppermost or first position. Such a switch could be, for example, a simple, normally open switch in series with SW8 that prevents SW8 from short circuiting the switch SW3 unless the arm 24 is pressing on the normally open switch located at the bracket 156.

A practical example of the invention involved apparatus which was installed in a slush molding factory as stated. The mechanical components are obvious from the drawings. The circuitry used the following components, whose purposes and functions have been explained in the discussion. Those not specifically mentioned will be understood by the skilled artisan as having obvious purposes and functions:

| Resistors, ohms | | | |
|---|---|---|---|
| R1 | 2.2K | R21 | 680 |
| R2 | 10K | R22 | 1K |
| R3 | 1.5K | R23 | 680 |
| R4 | 1.5K | R24 | 330 |
| R5 | 68K | R25 | 1K |
| R6 | 500K | R26 | 1K |
| R7 | 680 | R27 | 47K |
| R8 | 2.2K | R28 | 1K |
| R9 | 680 | R30 | 1.5K |
| R10 | 2.2K | R31 | 330 |
| R11 | 1K | R32 | 1.5K |
| R12 | 120K | R33 | 330 |
| R13 | 100K | R34 | 47K |
| R14 | 1.0m | R35 | 1.5K |
| R15 | 1K | R36 | 0–50K |
| R16 | 3.9K | R37 | 100K |
| R17 | 3.3K | R38 | 120K |
| R18 | 560 | R39 | 470K |
| R19 | 2.2K | R40 | 2.2m |
| R20 | 620 | R41 | 4.7m |

| Capacitors, microfarads (various voltages 25 to 125) | |
|---|---|
| C1 | 100 |
| C2 | 50 |
| C3 | .027 |
| C4 | 130 |
| C5 | 149 |
| C6 | 220 |
| C7 | 100 |
| C8 | 220 micro |

| Opto-Isolators | | |
|---|---|---|
| L1 | S1 | 4N33 |
| L2 | S2 | 4N33 |
| L3 | S3 | 4N33 |
| L4 | S4 | 4N33 |
| L5 | S5 | 4N33 |

| Lamps | |
|---|---|
| Pilot | L7 |
| Delay | L6 |

| Switches | | | |
|---|---|---|---|
| SW1 | SPST Toggle (N.O.) (44) | SW5 | SPST Toggle (MOM) (46) |
| SW2 | DPDT Toggle (56) | SW6 | 3P.6 POS. Rotary |
| SW3 | SPDT Roller (52) | SW7 | SPST (MOM) (N.C.) (122) |
| SW4 | SPDT Reset (174) | SW8 | Relay SPST 24 D.C. (48) |

| SCRs | |
|---|---|
| SC1 | C106 |
| SC2 | C106 |
| SC3 | C106 |
| SC4 | C106 |
| SC5 | C106 |
| SC6 | C106 |

| Triacs | |
|---|---|
| T1 | T24B2 |
| T2 | T24B2 |
| T3 | T24B2 |
| T4 | T24B2 |
| T5 | T24B2 |

| Transistors | |
|---|---|
| TR1 | 2N6025 |
| PUT1 | 2N6027 |
| PUT2 | 2N6027 |

Diodes

All conventional non-Zener type.

It will be appreciated that the basic structure as described herein has a great flexibility for application to many different conditions which can exist when it is required automatically to fill containers with liquids. On the same account, the details of the invention are capable of wide variation without departing from the spirit or scope of the invention as defined in the appended claims.

What it is desired to secure by Letters Patent of the United States is:

1. A system for automatically filling containers with liquid to a predetermined level, said containers being arranged in spaced locations along a line and each container having an opening to a cavity on its interior, a track defining a path parallel with the line of containers, a carriage mounted on the track for translative movement to and between stations along the track, an arm pivotally mounted at one end of the arm to the carriage and having its opposite end free and carrying a pouring nozzle, the arm adapted to be swung about its mounting in a vertical direction between at least two positions, the first of which is the normal position above the containers and spaced therefrom to permit movement of the carriage along the track without interference with the containers and the second of which is substantially below said first position and in which the nozzle is correctly disposed for filling the container and vertically aligned with the container opening in position to fill the same if the container is properly positioned, a source of liquid, a flexible conduit connected between the source and the pouring nozzle and having a normally closed valve between the source and the nozzle, first reversible drive means for driving the carriage along the track, second reversible drive means for raising and lowering the arm between said first and second positions, electrical circuitry for operating the system, comprising means for energizing the first drive means to move the carriage along said track in a first direction to a first station, means defining the station and deenergizing the first drive means and acting to energize the second drive means to lower the arm to bring the nozzle to correct disposition at said second position, control means acting to stop the second drive means lowering the arm if and when the arm reaches said second position and opening said valve to fill the container while preventing energizing of said second drive means while said container is being filled but thereafter closing said valve and energizing the second drive means in reverse to raise the arm to said first position, said control means acting to stop the second drive means lowering the arm in the event that the arm does not or is not capable of reaching said second position without opening said valve, reversing said second driving means and causing the arm to be returned to said first position and deenergizing the second drive means, said means for energizing said first drive means being once more enabled when the arm has been returned to said first position and acting to move said carriage to the next-to-be reached station with the arm retained in said first position, said next-to-be reached station and all other following stations each having elements cooperating with said carriage to provide means for stopping the carriage at each station in turn and attempting to fill the containers.

2. The system as claimed in claim 1 in which the end of said track has means cooperating with said carriage which stops the carraige and disables the first drive means and related electrical circuitry when said end is reached.

3. The system as claimed in claim 1 in which said track has means cooperating with said carriage which stops the carriage at said end and returns the carriage in the opposite direction to the other end of said track.

4. The system as claimed in claim 1 in which said track has means cooperating with said carriage which stops the carriage at said end, reverses the first drive means, and causes the carriage to return in the opposite direction, but stopping once more at each station enroute and attempting to fill the containers along said line.

5. The system as claimed in claim 4 in which said electrical circuitry includes delay means for delaying the return of the carriage in said opposite direction for a predetermined time after reaching the said end and stopping said carriage.

6. The system as claimed in claim 1 in which said control means includes a coupling between the second drive means and arm and a switch associated with the coupling, the coupling having structure adapted to throw the switch which is inoperative when the arm is moving without resistance being exerted against said movement other than the weight and friction of the arm and its parts but is operative when the arm meets added resistance to its movement.

7. The system as claimed in claim 6 in which said switch is a reset type switch adapted to close a first circuit and open a second circuit if the arm meets resistance while moving in one direction, but adapted to open the first circuit and close the second circuit if the arm meets resistance while moving in the other direction.

8. The system as claimed in claim 1 in which the control means includes delay means for delaying the energizing of the second drive means in reverse after the valve has been closed, if said valve had previously been opened and the container filled, whereby the arm will commence being raised to said first position for the delay time thereby giving the pouring nozzle an opportunity to drain before the arm is raised.

9. The system as claimed in claim 1 in which said arm includes means for sensing the level of the liquid in the container adapted to be placed in operative position only if and when the nozzle is correctly disposed relative to the container opening as aforesaid, said sensing means being operative when the level reaches a predetermined height to disable that portion of the control means which opened said valve and thereafter causing said energizing of the second drive means in reverse to raise the arm.

10. The system as claimed in claim 9 in which the control means includes delay means for delaying the energizing of the second drive means in reverse after said valve has been closed whereby the arm will commence being raised to said first position for the dleay time thereby giving the pouring nozzle an opportunity to drain before the arm is raised.

11. The system as claimed in claim 1 in which the arm has position feeler means in addition to said pouring nozzle at said free end, said position feeler means adapted to engage a portion of the container adjacent said opening only if and when the nozzle is correctly disposed relative to the opening, said control means including electrical circuitry arranged to effect the stopping of the movement of the arm downward and the filling of said container responsive to the engagement of the feeler means with said container portion.

12. The system as claimed in claim 1 in whcih said arm and second drive means have a mechanical coupling and a switch associated with said coupling, the coupling being inoperative to affect the switch during normal movement of the arm but being active to operate the switch when the arm movement is resisted, the control means being operative to reverse the second drive means by reason of the operation of said switch if the arm meets resistance in its downward movement and being operative to deenergize the second drive means if the arm meets resistance in its upward movement.

13. The system as claimed in claim 12 in which the carriage has stop means to exert resistance on the arm when it has been moved in an upward direction and reaches its first position.

14. The system as claimed in claim 12 in which, position feeler means are provided at said free end in addition to said nozzle, the position feeler means adapted to engage a portion of said container adjacent said opening only if and when the nozzle is correctly disposed relative to the opening, said feeler means including an electric circuit arranged to open the valve and start the filling of the container with liquid and disabling that portion of the control means which causes the arm to rise, such disablement obtaining until the container is filled, said feeler means being also effective when it so engages the said portion to exert resistance to the downward movement of the arm to cause operation of said switch to stop the energizing of the second drive means and to reverse the same to condition the same for rising.

15. The system as claimed in claim 14 in which the system is adapted to have means which will exert resistance on said arm in its downward movement in the event that the feeler means does not engage the said portion of the container whereby to cause the control means to stop the second drive means, reverse the second drive means and start the arm moving upward but without opening the valve.

16. A system for automatically filling containers with liquid to a predetermined level, said containers being arranged in spaced locations along a line and each container having an upper end defining a shoulder surrounding a mouth opening into a passageway leading to the interior of the container, a track defining a path parallel with the line of containers, a carriage mounted on the track for translative movement to and between stations along the track, an arm pivotally mounted at one end of the arm to the carriage and having its opposite free end carrying a pouring nozzle, the arm adapted to be swung about its mounting in a vertical movement which is substantially less than a revolution between at least two positions, the first of which is the normal position above the containers and spaced therefrom to permit movement of the carriage without interference with the containers and the second of which is substantially below said first position and in which the nozzle is correctly disposed for filling the container and being adjacent if not within the passageway and aligned with the mouth, a source of liquid, a flexible conduit connected between the source and the pouring nozzle and having a normally closed electrically energized valve between the source and the nozzle, first reversible drive means for driving the carriage along the track, second reversible drive means for raising and lowering the arm between said first and second positions, cooperating presence-sensing means on the carriage and along the track at stations adapted to be assumed by said carriage, said sensing means including a first type of element mounted on the carriage and a plurality of a second type of element respectively spaced along the track at said stations and having the same spacing as the containers and having a spatial relationship with said containers such that each time the carriage reaches a station and brings said first type of element into juxtaposition relative to a particular one of the second type of element the nozzle of the arm will normally be aligned with the mouth of a particular container that may be present on said line, electrical circuitry for operating the system comprising means for energizing the first drive means to move the carriage in a first direction along the track, means for de-energizing the first drive means when the first-reached station is occupied by the carriage and the first type of element of the carriage is in juxtaposition with the first-reached of the second type of element on the track and energizing the second driving means to move the arm in a downward direction toward a container which may be positioned thereat, sensing means associated with the arm and carraige for sensing whether a container is present and whether the container is properly aligned with the nozzle and responsive to reverse the second drive means to raise the arm after it has moved from said first position a certain degree downward unless the nozzle reaches said second position but also responsive to de-energize said second drive means if the nozzle does reach the second position, said circuitry including means for energizing said valve to open the same if and when the nozzle reaches said second position to commence filling said container, said circuitry also including means for detecting when the container is filled to said predetermined level, deenergizing said valve to close the same and cut off the flow of liquid, energizing said second drive means to raise said arm to said first position and starting said first drive means after said arm reaches said first position to move the carriage once more in said first direction away from the first-reached station toward the next-to-be-reached station.

17. The system as claimed in claim 16 in which means are included for disabling the means de-energizing the first drive means after it has reached the first-reachea station so that the first drive means may be energized thereafter to cause movement of the carriage notwithstanding it is still at said first-reached station and for disabling the second drive means fter the arm has returned to said second position and placing said second drive means in reversed condition so the arm will be lowered when the second drive means is thereafter energized.

18. The system as claimed in claim 16 in which means are provided associated with said carriage and at one end of the track comprising at least the end toward which the carriage moves in said first direction for reversing the said first drive means, whereby the carriage will move in a second opposite direction after reaching said end.

19. In a system for filling containers automatically, the containers being arranged in a line and each having an opening and a shoulder around the opening, the system including a track parallel to the line, a carriage adapted to move along the track from station to station, each station being located adjacent a container, a source of liquid, a pouring nozzle carried by the carriage, a valve between the source and the nozzle and adapted to be opened when the nozzle is placed over the opening of a container and closed after the container is filled, the invention herein which comprises:

A. an arm pivotally mounted at one end on the carriage and having the nozzle at its free end, B. drive means for moving the arm in an arc up and down between a first position in which the arm is raised free of the containers, and a second position in which the arm is lowered and the nozzle is in proper disposition to fill the container, C. means for moving the carriage from station to station and for stopping the carriage at each station, thereafter energizing the drive means to lower the arm, deenergizing the drive means when the arm is in said second position, opening the valve, filling the container, closing the valve, reversing the drive means and energizing the same once more thereby raising the arm, stopping movement of the arm when it reaches said first position by deenergizing said drive means and thereafter energizing the means to move the carriage to the next-to-be reached station.

20. The invention as claimed in claim 19 in which the arm is comprised of at least two pairs of parallel elongate members forming a rectangle in section, there being caddy means at the free end of the arm, the ends of the members being pivotally mounted to the carriage and the caddy means on two axes at each end which are vertically spaced apart whereby the movement of the arms in a vertical direction does not affect the disposition of the caddy means, said nozzle being mounted on the caddy means and thus capable of always being disposed vertically relative to the opening.

21. The invention as claimed in claim 20 in which the caddy means also carries a level sensing probe adapted to be inserted into the opening and also capable of remaining vertical at all times.

22. The invention as claimed in claim 19 in which the arm is coupled with the drive means through a slip clutch, the slip clutch is arranged to throw a switch for stopping and reversing the drive means of the arm, said slip clutch being normally inoperative during unobstructed movement of the arm but operative to throw the switch when the arm encounters resistance in its movement.

23. The invention as claimed in claim 19 in which means are provided to return the arm to the first position in the event that the second position is not reached when the arm moves downward.

24. The invention as claimed in claim 19 in which there is a level sensing probe on the free end of the arm in addition to the nozzle, the probe adapted to enter in the opening when the second position is reached and acting to close the valve when the desired level is reached and cause return of the arm to the second position.

25. The invention as claimed in claim 24 in which there are time delay means to delay raising the arm after said valve closes.

* * * * *